US009110424B2

(12) United States Patent
Kondo et al.

(10) Patent No.: US 9,110,424 B2
(45) **Date of Patent: *Aug. 18, 2015**

(54) IMAGE FORMING APPARATUS FORMING AN IMAGE ON ADHESIVE FACE OF PRINT MEDIUM

(71) Applicant: RICOH COMPANY, LTD., Tokyo (JP)

(72) Inventors: Kazuyoshi Kondo, Tokyo (JP); Kazuyoshi Matsumoto, Tokyo (JP); Makoto Kikura, Kanagawa (JP); Yuuzoh Obata, Tokyo (JP); Norikazu Yanase, Kanagawa (JP); Gaku Hosono, Kanagawa (JP); Yoshinori Uchino, Kanagawa (JP); Masateru Ujiie, Kanagawa (JP); Shu Kanno, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/045,931

(22) Filed: Oct. 4, 2013

(65) Prior Publication Data

US 2014/0105661 A1 Apr. 17, 2014

(30) Foreign Application Priority Data

Oct. 6, 2012 (JP) ..... 2012-223715
Jun. 19, 2013 (JP) ..... 2013-128760

(51) Int. Cl.

| | |
|---|---|
| ***B41J 3/407*** | (2006.01) |
| ***G03G 15/00*** | (2006.01) |
| ***B65C 9/18*** | (2006.01) |
| ***B41J 15/04*** | (2006.01) |

(52) U.S. Cl.

CPC ..... *G03G 15/6529* (2013.01); *B41J 3/4075* (2013.01); *B41J 15/046* (2013.01); *B41J 15/048* (2013.01); *B65C 9/18* (2013.01)

(58) Field of Classification Search

CPC ..... B41J 3/4075; B41J 15/048; B41J 15/046; B65C 9/18

See application file for complete search history.

(56) References Cited

U.S. PATENT DOCUMENTS 5,437,228 A * 8/1995 Uland ..... 101/288
6,172,688 B1 * 1/2001 Iwasaki et al. ..... 347/2

(Continued)

FOREIGN PATENT DOCUMENTS

JP 7-172006 7/1995
JP 2011-178500 9/2011

OTHER PUBLICATIONS

U.S. Appl. No. 13/950,473, filed Jul. 25, 2013.

(Continued)

*Primary Examiner* — Blake A Tankersley
(74) *Attorney, Agent, or Firm* — Cooper & Dunham LLP

(57) ABSTRACT

An image forming apparatus includes a roll body including a print medium wound around, the medium having an adhesive face, an image forming unit to form an image on the adhesive face, a conveyance unit having a pair of a conveyance rotor and an opposed rotor to convey the medium with the medium interposed between the conveyance rotor and the opposed rotor and an adhesive face guide unit to guide the medium when the conveyance unit returns the medium in a return direction opposite a conveyance direction of the medium. The adhesive face guide unit has a downstream rotor disposed downstream from the opposed rotor in the return direction and an endless adhesive face guide member wound around the opposed rotor and the downstream rotor. The adhesive face guide member is configured to receive and guide the adhesive face of the medium returned, in a separable state.

8 Claims, 13 Drawing Sheets

(56) References Cited

U.S. PATENT DOCUMENTS

2003/0035014 A1* 2/2003 Adams et al. ..... 346/135.1
2003/0035671 A1* 2/2003 Estabrooks ..... 399/385
2011/0081190 A1* 4/2011 Kan et al. ..... 400/621

OTHER PUBLICATIONS

U.S. Appl. No. 13/950,867, filed Jul. 25, 2013.

* cited by examiner

IMAGE FORMING APPARATUS FORMING AN IMAGE ON ADHESIVE FACE OF PRINT MEDIUM

CROSS-REFERENCE TO RELATED APPLICATIONS

This patent application is based on and claims priority pursuant to 35 U.S.C. §119 to Japanese Patent Application Nos. 2012-223715, filed on Oct. 6, 2012, and 2013-128760, filed on Jun. 19, 2013, in the Japan Patent Office, the entire disclosure of each of which is hereby incorporated by reference herein.

BACKGROUND

1. Technical Field

This disclosure relates to an image forming apparatus.

2. Description of the Related Art

Image forming apparatuses are used as printers, facsimile machines, copiers, plotters, or multi-functional devices having, e.g., two or more of the foregoing capabilities. For example, there is known an image forming apparatus, such as a label printer for printing on a print medium having an adhesive face with no release sheet adhering on the adhesive face (hereinafter also referred to as "linerless label sheet" or non-separate label), such as a tape or an unmounted label sheet, and cutting the print medium into a desirable length after printing to obtain a print medium piece (hereinafter also referred to as a "label piece"), or the like.

For example, an image forming apparatus includes a print head for printing a desirable mark on a print face of a label, a print roller disposed near the print head to press the label toward the print head during printing, a separation bar disposed at an interval from the print roller, and an endless belt to be moved around the print roller and the separation bar. The image forming apparatus has a structure in which the label adheres to the belt in the print head and is conveyed to the separation bar, and the label is separated from the belt in the position (JP-H07-172006-A).

In a case in which a roll-shaped print medium is used, when an image forming operation is carried out and a print medium is conveyed to a cutting position and cut into a label piece, an image is not formed in an area opposing an image forming unit. As a result, if the image forming operation is restarted with the print medium placed in the exact position, the print medium would be wasted.

Hence, before the image forming operation is restarted or when there is no image to be formed subsequently, a returning operation may be performed to return a leading end of the print medium to a position upstream from the image forming unit in a conveyance direction of the print medium, thus reducing the waste of the print medium.

However, for such a configuration, in particular, if a slack occurs in a print medium, such as a linerless label sheet, having an exposed adhesive face, different portions of the adhesive face might adhere to each other or the adhesive face may adhere to a different member, thus hampering the returning operation.

Additionally, in a case in which the print medium is conveyed by paired rotors, the adhesive face might adhere to one of the rotors disposed on the adhesive face side in a nipping portion between the paired rotors. As a result, the print medium might be wound around the rotor, thus hampering the returning operation.

BRIEF SUMMARY

In at least one exemplary embodiment of this disclosure, there is provided an image forming apparatus including a roll body, an image forming unit, and a conveyance unit. The roll body includes a print medium wound around. The print medium has an adhesive face. The image forming unit forms an image on the adhesive face of the print medium. The conveyance unit conveys the print medium to a position at which the print medium opposes the image forming unit, with the adhesive face placed as a front face side of the print medium. The conveyance unit has a pair of a conveyance rotor and an opposed rotor to convey the print medium with the print medium interposed between the conveyance rotor and the opposed rotor and an adhesive face guide unit to guide the print medium when the conveyance unit returns the print medium in a return direction opposite a conveyance direction of the print medium. The adhesive face guide unit has a downstream rotor disposed downstream from the opposed rotor in the return direction and an endless adhesive face guide member wound around the opposed rotor and the downstream rotor. The endless adhesive face guide member is configured to receive and guide the adhesive face of the print medium returned, in a separable state.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
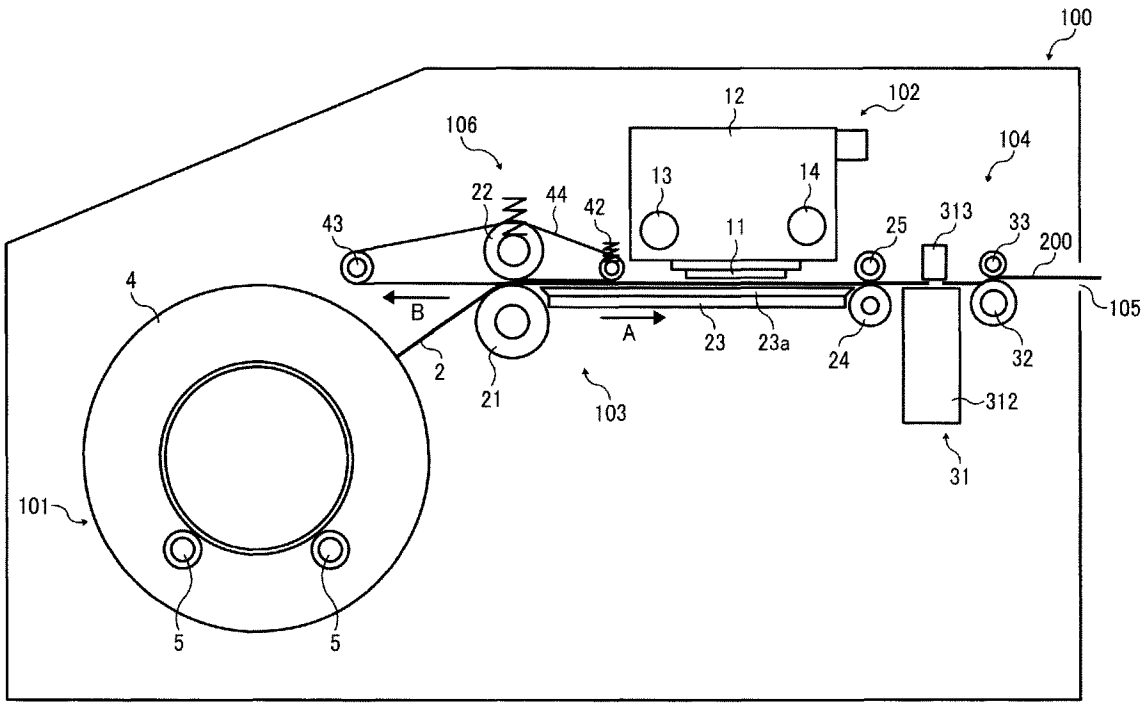
FIG. 1 is a side view of an image forming apparatus according to a first exemplary embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

The term "image formation" used herein includes providing not only meaningful images, such as characters and figures, but meaningless images, such as patterns, to print media (in other words, the term "image formation" also includes causing liquid droplets to land on print media).

The term "ink" is not limited to "ink" in a narrow sense, unless specified, but is used as a generic term for any types of liquid usable as targets of image formation. For example, the term "ink" includes recording liquid, fixing solution, liquid, and so on.

The term "image forming apparatus", unless specified, also includes both serial-type image forming apparatus and line-type image forming apparatus.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, an image forming apparatus according to a first exemplary embodiment of the present disclosure will be described with reference to FIGS. 1 to 3.

Figure 2:
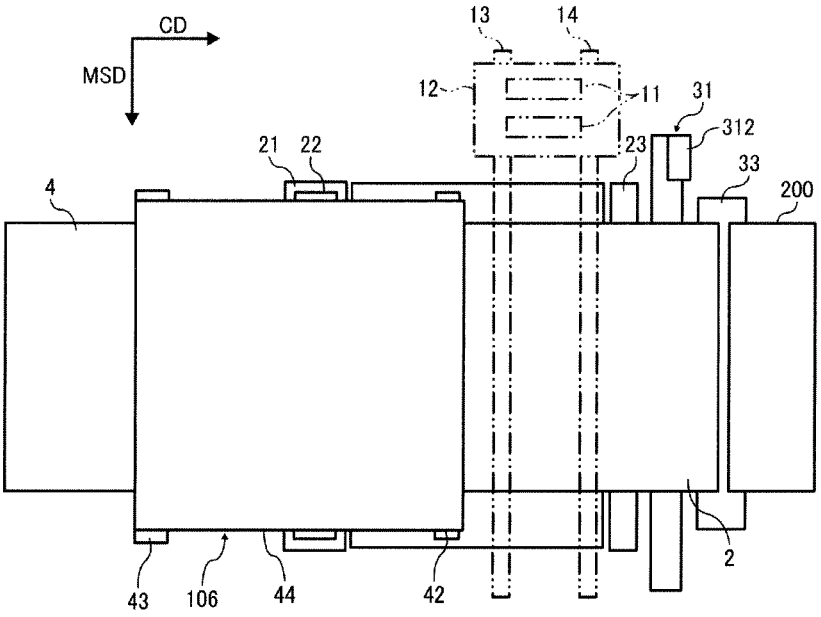
FIG. 2 is a plan view of a portion of the image forming apparatus of FIG. 1.

FIG. 1 is a side view of an image forming apparatus according to a first exemplary embodiment of the present disclosure. FIG. 2 is a plan view of a portion of the image forming apparatus of FIG. 1. FIG. 3 is a view of an adhesive face guide unit.

The image forming apparatus includes an apparatus body 100 having a sheet feeder 101 for feeding a print medium 2, an image forming unit 102 to be an image forming device for forming an image on the print medium 2, and a conveyer 103 to be a conveyance unit which is opposed to the image forming unit 102 and serves to convey the print medium 2. Moreover, an output conveyer 104 and an adhesive face guide unit 106 are disposed in the apparatus body 100. The output conveyer 104 serves to convey, toward an output port 105, the print medium 2 having an image formed thereon which is fed from the conveyer 103. The adhesive face guide unit 106 serves to guide the print medium 2 in conveyance and return of the print medium 2.

A roll body 4 having the print medium 2 wound like a roll is loaded into the sheet feeder 101. The roll body 4 is rotatably supported by roll body supporting members 5 and 5.

Figure 3:
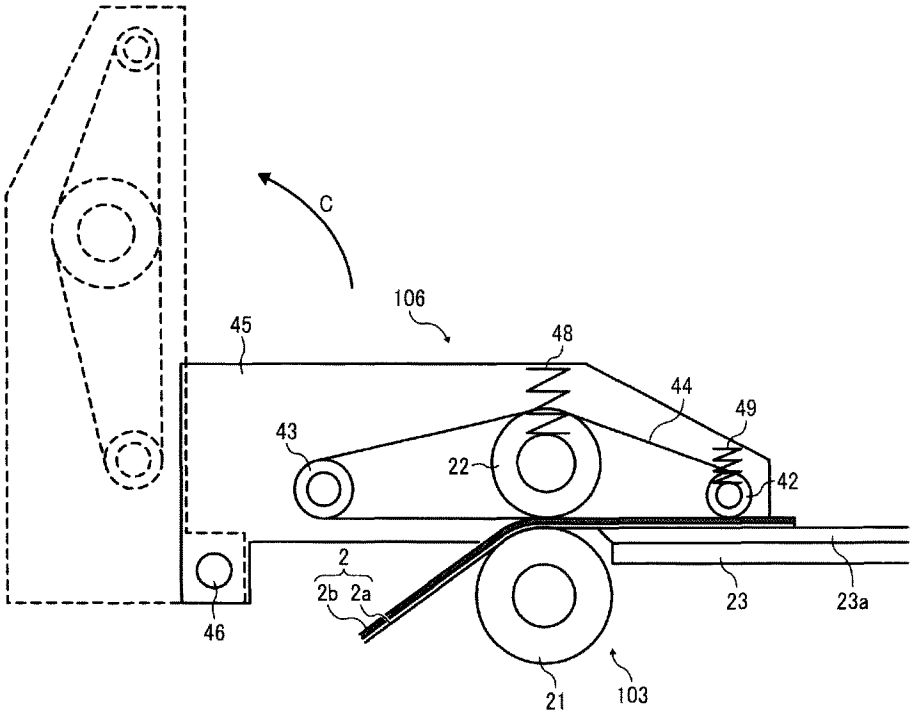
FIG. 3 is a view of an adhesive face guide unit.

As shown in FIG. 3, the print medium 2 is a continuous body in which an adhesive layer (hereinafter also referred to as an "adhesive face") 2*b* is formed over a medium 2*a* on which an image can be formed (hereinafter also referred to as a "print face"), and the adhesive face 2*b* has no mount (a release sheet or a separator) pasted thereto.

The print medium 2 is fed from the sheet feeder 101 with the adhesive face 2*b* set to be a front face thereof, that is, in a state in which an image is formed by the image forming unit 102 on the adhesive face 2*b* side of the medium 2*a* on which the image can be formed.

The image forming unit 102 includes a carriage 12 provided with a recording head 11 constituted by a liquid discharging head for discharging a droplet to the print medium 2. The carriage 12 is held movably on guide members 13 and 14 and is reciprocated in a direction perpendicular to a conveyance direction of the print medium 2 indicated by an arrow CD in FIG. 2.

The recording head 11 is a head having two nozzle lines. Two recording heads 11 are used to discharge ink droplets having respective colors of black (K), cyan (C), magenta (M) and yellow (Y) through four nozzle lines, respectively. However, the recording head is not restricted thereto but a line type head can also be used.

Moreover, the image forming unit 102 is not restricted to the configuration of the liquid discharging head but various image forming units for forming an image in contact and non-contact can be used.

The conveyer 103 has a conveyance roller 21 and an opposed roller 22 to be an opposed rotor which is opposed to the conveyance roller 21. The conveyance roller 21 and the opposed roller 22 form a pair of conveyance rotors which constitute paired rotors for interposing and conveying the print medium 2 in a direction of an arrow A of FIG. 1 (conveyance direction CD in FIG. 2) with the adhesive face 2*b* set to be a front face side. Moreover, the conveyer 103 has a platen member 23 to be a guide member for guiding the print medium 2, a roller 24 on an output side, and a spur 25 opposed to the roller 24. A plurality of ribs 23*a* for supporting the print medium 2 is formed on a front face of the platen member 23 in an extending shape in the conveyance direction CD.

Although the guide member for guiding the print medium 2 opposite to the image forming unit 102 is constituted by the platen member 23, the guide member is not restricted thereto. For example, the guide member can also be constituted by a conveyance belt (including a conveyance belt for carrying out electrostatic adsorption or sucking adsorption) which is laid between the conveyance roller 21 and a driven roller corresponding to the roller 24 on a downstream side in the conveyance direction CD.

A cutter unit 31 is disposed in the output conveyer 104. The cutter unit 31 is a cutting unit for cutting the print medium 2 into a predetermined length to obtain a print medium piece (a label piece) 200. The cutter unit 31 has a receiving member 312 for receiving the print medium 2 fed from a part between the roller 24 and the spur 25, and a cutting blade (a cutter) 313 for cutting the print medium 2, and the cutter 313 is moved in a direction (main scanning direction) MSD perpendicular to the conveyance direction CD, thereby cutting the print medium 2.

An output roller 32 is disposed on a downstream side of the cutter unit Asp roller 33 is disposed opposite to the output roller 32. The output roller 32 and spur roller 33 hold a leading end of the label piece 200 cut by the cutter unit 31 in a feeding condition to the output port 105.

A front face of the output 2 which holds the label piece 200 is subjected to a non-adhesive treatment (a treatment for non-adhesion of an adhesive face), for example, and the adhesive face 2*b* of the label piece 200 can be peeled. In this case, the output roller 32 itself can also be formed by a material which can be peeled.

The adhesive face guide unit 106 has a second roll 42 on a downstream side in the conveyance direction CD of the opposed roller 22 serving as a first roller constituting the conveyer 103. The second roller 42 serves as a separation roller disposed on an upstream side in the conveyance direction CD of the image forming unit 102.

Moreover, the adhesive face guide unit 106 has a third roller 43 on an opposite side to the second roller 42 with the opposed roller 22 interposed therebetween. The third roller 43 is a downstream side rotor which is disposed on a downstream side in a return direction (a direction of an arrow B) to be a reverse direction to the conveyance direction CD.

In the adhesive face guide unit 106, a guide belt 44 to be an endless adhesive face guide member is laid among the opposed roller 22, the second roller 42 and the third roller 43.

For instance, the guide belt 44 is a belt-shaped member containing polyimide as a base material and having, on a surface layer, a mold releasing layer (for example, silicone coating) which enhances a mold releasing property from the adhesive face 2*b* of the print medium 2.

The opposed roller 22, the second roller 42 and the third roller 43 are held on a holder member 45, and the guide belt 44 is rotatably laid thereamong.

The holder member 45 is disposed rotatably in a direction of an arrow C in FIG. 3 with a shaft 46 set to be a rotation center. The holder member 45 can be displaced between a position (a position shown in a solid line of FIG. 3) at which the opposed roller 22 is opposed to the conveyance roller 21 and a position (a position shown in a dotted line of FIG. 3) at which the opposed roller 22 is separated from the conveyance roller 21 to open a part between the opposed roller 22 and the conveyance roller 21.

The part between the opposed roller 22 and the conveyance roller 21 is opened when the roll body 4 is loaded to set the print medium 2 onto the platen member 23, and the opposed roller 22 is pushed against the conveyance roller 21 side when the print medium 2 is to be conveyed.

The opposed roller 22 is pressurized toward the conveyance roller 21 side by a pressing unit 48 such as a spring. The second roller 42 is pressurized toward the platen member 23 side by a pressing unit 49 such as a spring.

In the image forming apparatus thus constituted, the print medium 2 and the guide belt 44 are interposed together between the conveyance roller 21 and the opposed roller 22 and the conveyance roller 21 is rotated and driven so that the print medium 2 is fed toward the image forming unit 102 in a state in which the adhesive face 2*b* of the print medium 2 is integrated with the guide belt 44. In the middle of the conveyance, the guide belt 44 is peeled from the adhesive face 2*b* of the print medium 2 and a desirable image is formed on the adhesive face 2*b* by the recording head 11 of the image forming unit 102.

The print medium 2 having an image formed thereon is fed to the output conveyer 104 and is cut at a predetermined position by the cutter unit 31, and is thus changed into the print medium piece (the label piece) 200 and is held between the output roller 32 and the spur roller 33 in a state in which it can be pulled out of the output port 105 of the apparatus body 100.

When the print medium 2 is interposed between the conveyance roller 21 and the opposed roller 22, the surface layer of the guide belt 44 comes in contact with the adhesive face 26 of the print medium 2 so that the print medium 2 and the guide belt 44 are moved together by the rotation of the conveyance roller 21. Consequently, the print medium 2 is conveyed toward the image forming unit 102 in a state in which the adhesive face 2*b* is protected by the guide belt 44.

A moving direction of the guide belt 44 is rapidly changed by the second roller 42 having a smaller diameter as compared with the opposed roller 22. Therefore, the guide belt 44 is peeled from the adhesive face 2*b* of the print medium 2 so that only the print medium 2 is fed to the image forming unit 102.

At this time, the second roller 42 is pressurized toward the platen member 23 side by the pressing unit 49. Therefore, the print medium 2 is pushed against the platen member 23 and is stably conveyed to the image forming unit 102.

Thus, the adhesive face of the print medium is first guided and moved by the guide belt, and the guide belt is peeled from the adhesive face before printing. Also in a case in which an adhesive face having no release sheet in the print medium is set to be a front face and paired rollers constituted by the conveyance roller and the opposed roller are used to convey the print medium to an opposed position to the image forming unit, consequently, the print medium can be conveyed stably.

In other words, in a case in which the print medium 2 having no mount pasted to the adhesive face 2*b* is fed and conveyed as a roll body, for example, a relatively great force is needed to separate the print medium 2 from the roll body against an adhesive force of the print medium 2. The force is generated at a nipping portion between the opposed roller 22 and the conveyance roller 21. To obtain such a great force, the nipping portion may be set to be large to increase a contact area with the print medium 2.

For this purpose, it is effective to increase the diameters of the opposed roller 22 and the conveyance roller 21. In a case in which the diameter of the opposed roller 22 is increased, a curvature formed by the opposed roller 22 is reduced in the conveyance in which the adhesive face 2*b* is set to be a front face. For this reason, the adhesive face 2*b* adheres to the opposed roller 22, and is thus moved together and is wound therearound.

On the other hand, if an opposed roller having a small diameter is employed to prevent the adhesive face 2*b* from being wound around the opposed roller 22, the nip area is reduced as described above so that the print medium 2 slips between the rollers and stable conveyance cannot be carried out.

As in the present embodiment, therefore, the guide belt 44 is wound around two rollers having different diameters from each other. The guide belt 44 is pushed against the adhesive face 2*b* to be the front face of the print medium 2 to convey the print medium 2 so that the area of the nipping portion between the opposed roller 22 and the conveyance roller 21 can be increased and a separating portion from the guide belt 44 can increase the curvature of the roller to easily carry out the separation. Thus, the stable conveyance can be performed.

Next, the operation for returning the print medium 2 will be described with reference to FIG. 4.

Figure 4:
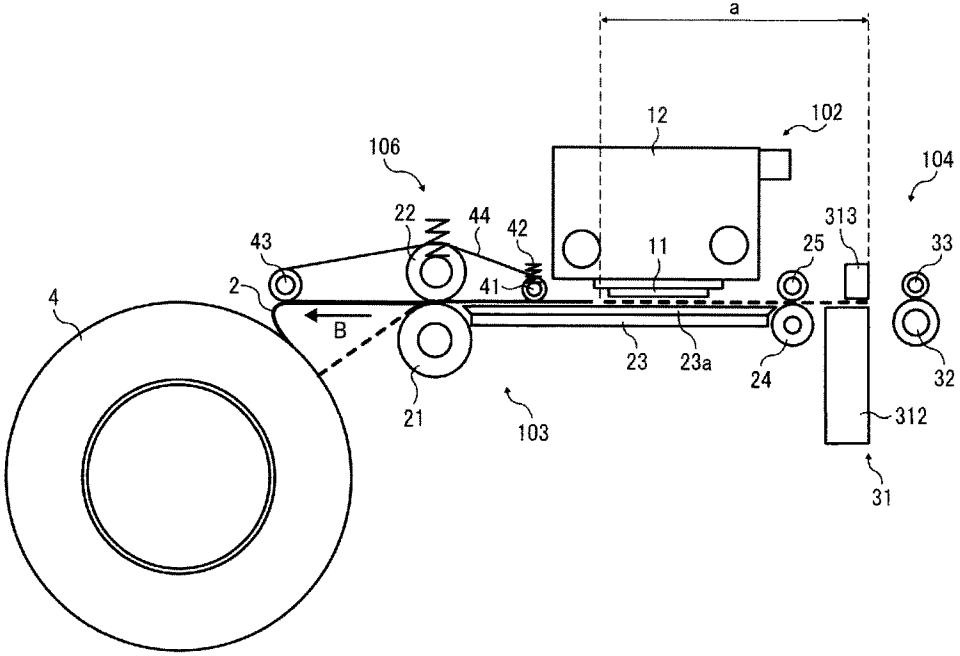
FIG. 4 is a side view of a portion of the image forming apparatus in an operation for returning a print medium.

FIG. 4 is a side view of a portion of the image forming apparatus in an operation for returning a print medium.

In a state in which the image formation is ended and the print medium 2 is cut by the cutter unit 31, the leading end of the print medium 2 is placed at the position of the cutter unit 31 and an area of the print medium 2 which is opposed to the image forming unit 102 serves as an unused area. If a next image forming operation is exactly restarted, the unused area of the print medium 2 is useless. Therefore, the operation for returning the print medium 2 in a return direction (a direction of an arrow B) is carried out up to a position at which the leading end of the print medium 2 reaches this side (an upstream side) of the image forming unit 102.

When the print medium 2 is to be returned, the conveyance roller 21 is rotated and driven in a reverse direction to the conveyance direction. Consequently, the print medium 2 is conveyed (returned) in the direction of the arrow B which is the reverse direction to the conveyance direction in the image formation.

At this time the returned part of the print medium 2 is moved in the return direction (the direction of the arrow B) in a state in which adhesion to the guide belt 44 is carried out by small adhesive force. The moving direction of the guide belt 44 is rapidly varied by the third roller 43 having a smaller diameter than that of the opposed roller 22. Therefore, the guide belt 44 is peeled from the adhesive face 2*b* of the print medium 2.

Thus, the adhesive face 2*b* of the print medium 2 is returned in a state in which it is protected by the guide belt 44. Therefore, it is possible to prevent the return from being disabled due to the adhesion of the adhesive faces 2*b* or the adhesion of the adhesive face 2*b* to another member.

Since an image is formed on the adhesive face 2*b* of the print medium 2, moreover, there is a fear that the adhesive face 2*b* of the print medium 2 might adhere to the opposed roller 22 having a small curvature and might be exactly wound around the opposed roller 22 also in the return. Therefore, the guide belt 44 is provided and the third roller 43 having a smaller diameter and a greater curvature in the return direction than those of the opposed roller 22 is provided. Consequently, it is possible to prevent the print medium 2 from being wound around the opposed roller 22 and to carry out stable separation at the position of the third roller 43. Therefore, it is possible to carry out a stable returning operation.

In the exemplary embodiment, in order to improve a separation property of the guide belt 44 from the adhesive face 2*b* of the print medium 2, that is, to enhance a separation property of the adhesive face 2*b* of the print medium 2 from the guide belt 44, it is preferable to form a plurality of very small convex-shaped portions in a mold releasing layer of the guide belt 44 (silicone coating on the surface layer), for example (the following exemplary embodiments will be the same).

For example, it is possible to form the very small convex shape by distributing glass beads (a diameter of approximately 200 μm) in a volume ratio of approximately 50% over the surface layer of the guide belt 44.

Thus, it is possible to reduce the contact area of the guide belt 44 and the adhesive face 2*b* of the print medium 2. Consequently, it is possible to enhance the separation property of the guide belt 44 from the adhesive face 2*b* of the print medium 2.

By employing the structure in which an adhesive face guide unit for guiding the return of a print medium is provided, the adhesive face guide unit has a downstream side rotor disposed on a downstream side in a return direction to be a reverse direction to a conveyance direction from an opposed rotor and an endless adhesive face guide member laid between the opposed rotor and the downstream side rotor, and an adhesive face of the print medium is guided by the adhesive face guide member in a releasable state when the print medium is to be returned, thus, it is possible to stably carry out an operation for returning a print medium having an adhesive face without a release sheet in a state in which an upper face is set to be the adhesive face.

Next, a second exemplary embodiment according to the present disclosure will be described with reference to FIG. 5.

Figure 5:
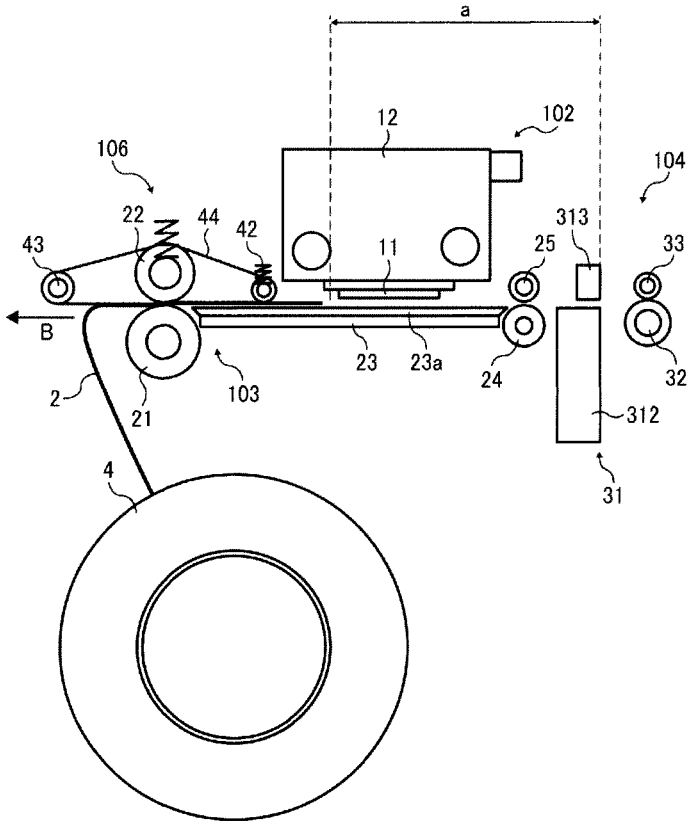
FIG. 5 is a side view of a portion of an image forming apparatus in a returning operation according to a second exemplary embodiment of the present disclosure.

FIG. 5 is a side view of a portion of an image forming apparatus in a returning operation according to a second exemplary embodiment of the present disclosure.

In the present embodiment, a roll body 4 is disposed below a conveyance roller 21 to be a conveyance rotor.

With the structure, when a print medium 2 is to be returned, it is relatively pulled from a guide belt 44 toward the roll body 4 side by adhesive force of the print medium 2 wound around the roll body 4 (reaction force acts on the print medium 2 from the roll body 4 side). Therefore, the print medium 2 is peeled from the guide belt 44.

As compared with the first exemplary embodiment, consequently, a position at which the print medium 2 is peeled from the guide belt 44 in return can be set to be a closer position to an opposed roller 22. Accordingly, it is possible to reduce a length of the guide belt 44 from the opposed roller 22 to a third roller 43 and to decrease a dimension in a lateral direction of an apparatus (a transverse direction in FIG. 5), thereby implementing reduction in a size.

In the case of a structure in which the print medium 2 is peeled from the guide belt 44 between the opposed roller 22 and the third roller 43 as shown in FIG. 5, moreover, the third roller 43 itself does not require a separating function. For this reason, the third roller 43 does not always need to have a smaller diameter than that of the opposed roller 22.

Next, a third exemplary embodiment according to the present disclosure will be described with reference to FIG. 6.

Figure 6:
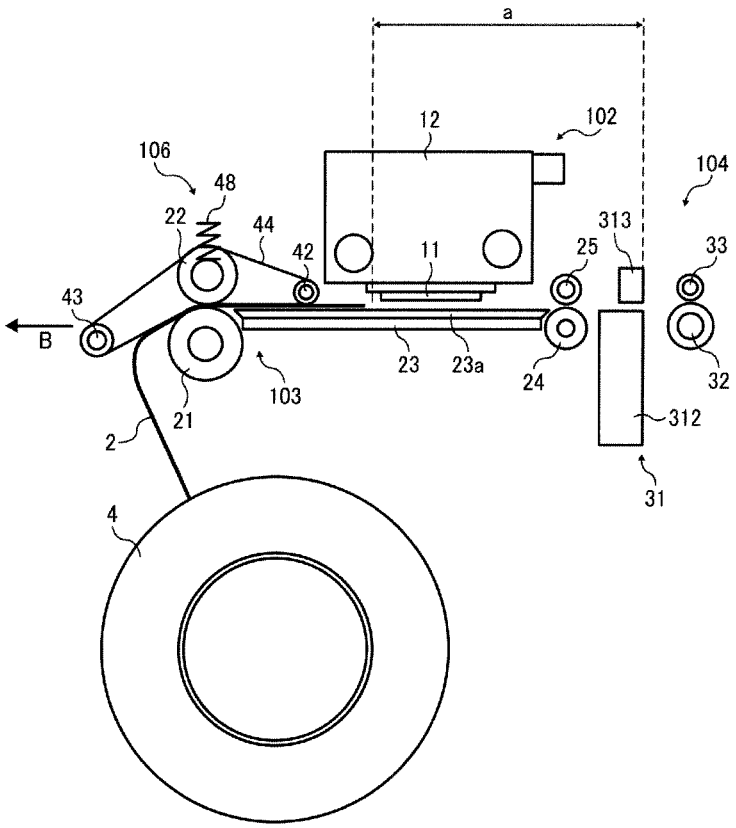
FIG. 6 is a side view of a portion of an image forming apparatus in a returning operation according to a third exemplary embodiment of the present disclosure.

FIG. 6 is a side view of a portion of an image forming apparatus in a returning operation according to a third exemplary embodiment of the present disclosure.

In the present embodiment, a third roller 43 to be a downstream side rotor around which a guide belt 44 is wound is disposed in such a manner that a lowermost end of a peripheral face is positioned below a nipping portion between a conveyance roller 21 and an opposed roller 22 (is placed at a lower position than the nipping portion). Consequently, a part of the guide belt 44 from the opposed roller 22 to the third roller 43 is inclined obliquely downward with respect to a conveyance face. The conveyance face implies a face to which the print medium 2 conveyed by the conveyance roller 21 conforms.

With the structure, in addition to the function and effect of the second exemplary embodiment, it is possible to prevent pressing force of the opposed roller 22 from being decreased by tension of the guide belt 44.

In other words, when the lowermost end of the peripheral face of the third roller 43 is positioned above the nipping portion between the conveyance roller 21 and the opposed roller 22, the guide belt 44 tries to bring the opposed roller 22 up against the pressing force. For this reason, there is a fear that the pressing force might lack. On the other hand, the lowermost end of the peripheral face of the third roller 43 is positioned below the nipping portion between the conveyance roller 21 and the opposed roller 22 so that the drawback is prevented from being caused.

Next, a fourth exemplary embodiment according to the present disclosure will be described with reference to FIG. 7.

Figure 7:
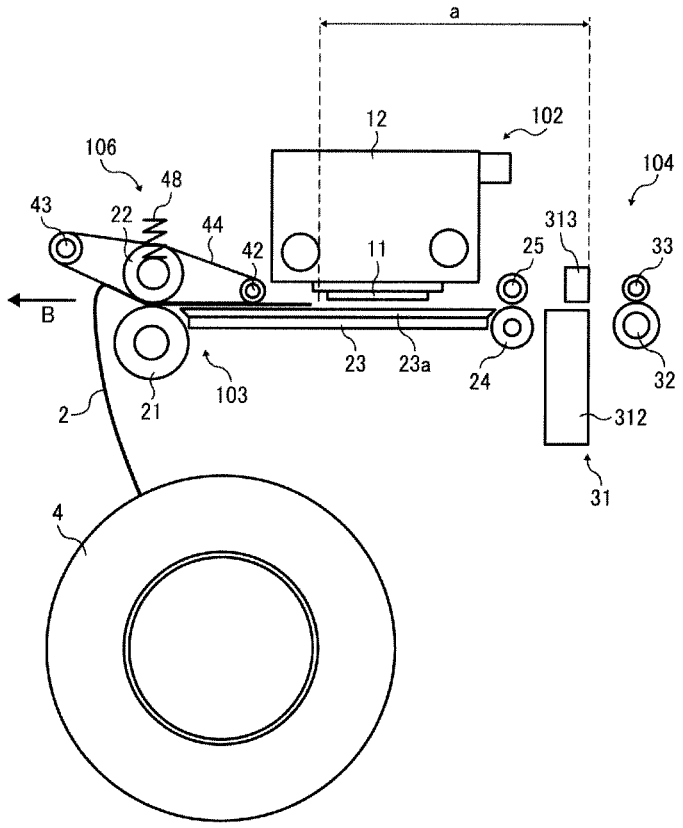
FIG. 7 is a side view of a portion of an image forming apparatus in a returning operation according to a fourth exemplary embodiment of the present disclosure.

FIG. 7 is a side view of a portion of an image forming apparatus in a returning operation according to a fourth exemplary embodiment of the present disclosure.

In the present embodiment, a third roller 43 to be a downstream side rotor around which a guide belt 44 is wound is disposed in such a manner that a lowermost end of a peripheral face is positioned above a nipping portion between a conveyance roller 21 and an opposed roller 22 (is placed at a higher position than the nipping portion). Consequently, a portion of the guide belt 44 from the opposed roller 22 to the third roller 43 is inclined obliquely upward with respect to a conveyance face.

In this case, it is possible to dispose an intermediate roller for applying tension to the guide belt 44 between the third roller 43 and a second roller 42 depending on the position of the third roller 43.

With the structure, the guide belt 44 is disposed with more inclination in a longitudinal direction as compared with the second exemplary embodiment. Therefore, it is possible to reduce a dimension in a lateral direction of an apparatus (a transverse direction of FIG. 7) more greatly than that in the second exemplary embodiment. Moreover, a distance between a roll body 4 and the guide belt 44 is longer than that in the third exemplary embodiment. Consequently, it is also possible to increase a return enabling amount of a print medium 2.

Next, a fifth exemplary embodiment according to the present disclosure will be described with reference to FIG. 8.

Figure 8:
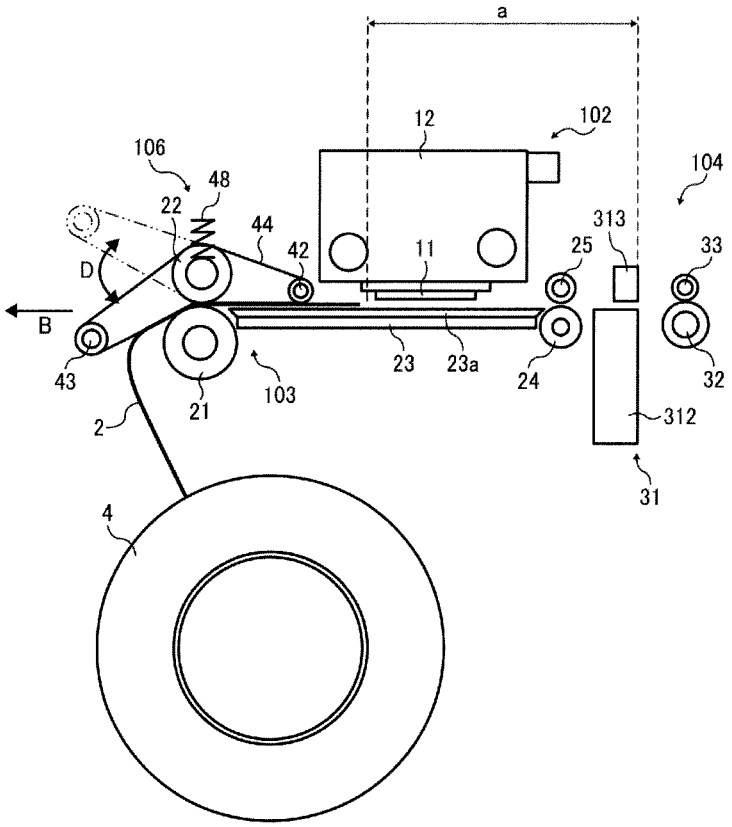
FIG. 8 is a side view of a portion of an image forming apparatus in a returning operation according to a fifth exemplary embodiment of the present disclosure.

FIG. 8 is a side view of a portion of an image forming apparatus in a returning operation according to a fifth exemplary embodiment of the present disclosure.

In the present embodiment, a third roller 43 is disposed to be displaceable in a direction of an arrow D so that an incineration angle of a guide belt 44 can be varied. In other words, a part from an opposed roller 22 to the third roller 43 is disposed to enable adjustment of a posture in a direction along a conveyance direction.

With the structure, it is possible to deal with various return amounts by changing the inclination angle of the guide belt 44 depending on a variation in the return amount of a print medium 2. In the case of the print medium 2 which requires a pressure of a nipping portion between a conveyance roller 21 and the opposed roller 22 and tends to slip depending on a type of the print medium 2, moreover, it is also possible to move the third roller 43, thereby carrying out switching to take a close configuration to that in the third exemplary embodiment.

Next, a sixth exemplary embodiment according to the present disclosure will be described with reference to FIG. 9.

Figure 9:
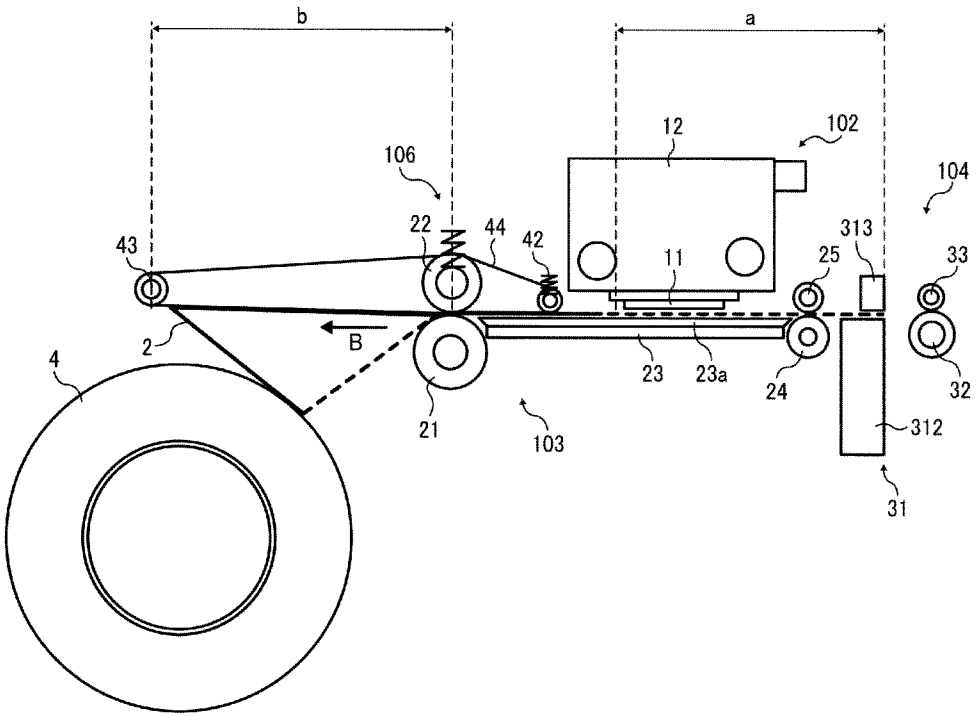
FIG. 9 is a side view of a portion of an image forming apparatus in a returning operation according to a sixth exemplary embodiment of the present disclosure.

FIG. 9 is a side view of a portion of an image forming apparatus in a returning operation according to a sixth exemplary embodiment of the present disclosure.

In the present embodiment, a length b of a part of a guide belt 44 from an opposed roller 22 to a third roller 43 is set to be greater than a return amount a (b □ a).

With the structure, a part of a returned print medium 2 is not once peeled from the guide belt 44 but all areas can be held by the guide belt 44.

Consequently, an adhesive face 2*b* of the returned print medium 2 is protected by the guide belt 44. Therefore, it is possible to reliably prevent a fear of adhesion to another member. Moreover, it is also possible to prevent deterioration in adhesiveness of the adhesive face 2*b* due to repetition of adhesion to and separation from the guide belt 44.

In the image forming apparatus, the guide belt 44 to be a guide belt member wound around the opposed roller 22 and a second roller 42 is disposed opposite to a conveyer 103. In order to deal with setting of the roll sheet 2 or a conveyance failure, therefore, an adhesive face guide unit 106 can be opened/closed.

In a case in which the adhesive face guide unit 106 can be opened/closed, thus, the adhesive face guide unit 106 is pushed toward the conveyer 103 side more greatly than that in conveyance in order to cause a locking mechanism to act when the adhesive face guide unit 106 is closed. For this reason, the second roller 42 is movable in a separating direction from the conveyer 103. A larger amount of pushing than that in the conveyance is referred to as "overstroke".

In a case in which the second roller 42 is movable in the separating direction from the conveyer 103, however, force acts, by belt tension, in such a direction that the second roller 42 to be a pressing roller is separated from the conveyer 103 side when the guide belt 44 is rotated. For this reason, the effect of the second roller 42 to be the pressing roller is insufficient. Consequently, the roll sheet adheres to a peripheral component so that a drawback such as a conveyance failure is caused.

Therefore, description will be given to an exemplary embodiment in which insufficient pressing force is prevented from being caused by a pressing roller also in a case in which a guide belt member is used. Although the description will be given with a structure in which the third roller (the downstream side rotor) 43 according to each of the above-described exemplary embodiments is not provided, the present invention can be executed in the same manner also in the case in which the third roller (the downstream side rotor) 43 is provided.

First, a seventh exemplary embodiment according to the present disclosure will be described with reference to FIGS. 10 and 11.

Figure 10:
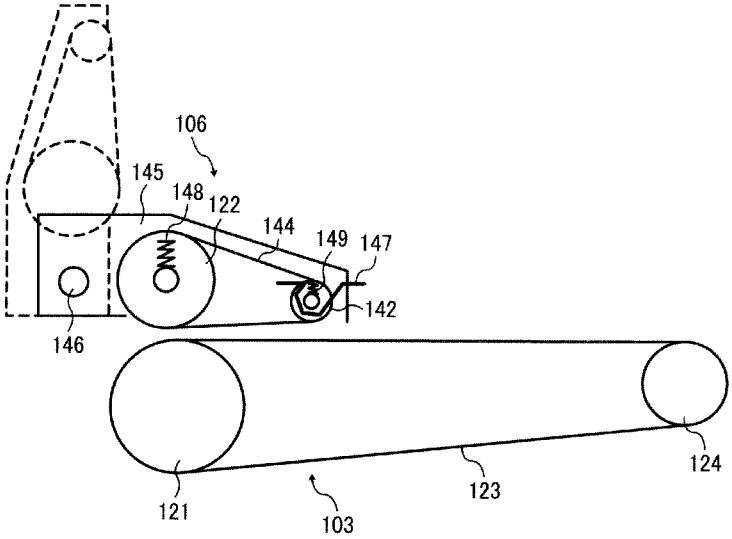
FIG. 10 is a side view of a portion of an image forming apparatus in a returning operation according to a seventh exemplary embodiment of the present disclosure.

FIG. 10 is a side view of a portion of an image forming apparatus in a returning operation according to a seventh exemplary embodiment of the present disclosure. FIG. 11 is a view of a conveyance guide unit. In FIG. 10 and succeeding drawings, a structure corresponding to a third roller 43 is not shown.

In the present embodiment, a conveyer 103 has a conveyance belt 123 laid between a conveyance roller 121 and a tension roller 124, and an adhesive face guide unit 106 to be a conveyance guide unit is disposed opposite to the conveyance belt 123.

Moreover, the adhesive face guide unit 106 to be the conveyance guide unit has a second roller 142 to be a second rotor serving as a pressing roller which is disposed on an upstream side in a conveyance direction of an image forming unit 102 at a downstream side in the conveyance direction of an opposed roller 122 serving as a first rotor constituting the conveyer 103 in almost the same manner as in the above-described exemplary embodiment.

In the adhesive face guide unit 106, a guide belt 144 serving as an endless guide belt member is laid between the opposed roller 122 and the second roller 142.

The opposed roller 122 and the second roller 142 are held on a holder member 145. The holder member 145 is disposed rotatably around a shaft 146 in the same manner as the holder member 45 according to the first exemplary embodiment.

Moreover, there are provided a pressing unit 148 such as a spring for pressing the opposed roller 122 toward the conveyance roller 121 side and a pressing unit 149 such as a spring for pressing the second roller 142 toward the conveyance belt 123 side of the conveyer 103.

Figure 11:
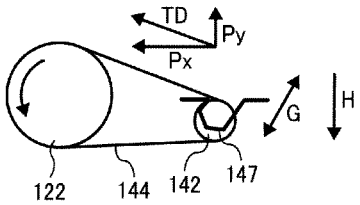
FIG. 11 is a view of a conveyance guide unit.

As shown in FIG. 11, the second roller 142 to be the second rotor is held movably in a direction of an arrow G (hereinafter referred to as a "guide direction") which is perpendicular to a tension direction TD of the guide belt 144 by a guide member 147 provided on the holder member 145.

On the other hand, a pressing direction of the pressing unit 149 for pressing the second roller 142 toward the conveyance belt 123 side is set to be a direction of an arrow H to be the direction (the direction of the arrow G) in which the second roller 142 can be moved toward the conveyance belt 123 side. Although the pressing direction (the direction of the arrow H) of the pressing unit 149 is set to be a perpendicular direction to a front face of the conveyance belt 123, the pressing direction is not restricted thereto.

With the structure, when the holder member 145 is rotated and locked into a state in which the opposed roller 122 and the second roller 142 are pushed toward the conveyance belt 123 side, the opposed roller 122 and the second roller 142 can be moved in a push-up direction by the conveyance belt 123 and is energized toward the conveyance belt 123 by the pressing units 148 and 149.

When the guide belt 144 is rotated in a direction of an arrow in FIG. 11, force is applied in the tension direction TD of the guide belt 144 so that force components Px and Py in X and Y directions are generated. The tension force component Py is force for lifting the second roller 142 in a vertical direction. Since the guide direction G of the second roller 142 is perpendicular to the tension direction TD, however, the second roller 142 is prevented from being lifted.

Consequently, it is possible to prevent the pressing force of the second roller 142 from being decreased, thereby enabling stable conveyance. It is also possible to produce these effects without depending on the presence of the third roller even if the adhesive face guide unit has a 2-roller structure or a 3-roller structure.

Figure 12:
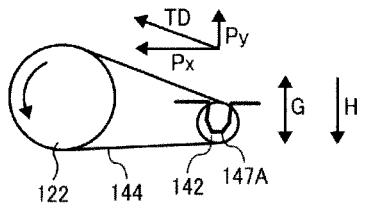
FIG. 12 is a view of a conveyance guide unit according to a comparative example.

In other words, in the related art, the guide direction G of the second roller 142 through a guide member 147A is not perpendicular to the tension direction TD of the guide belt 144 differently from a comparative example shown in FIG. 12.

When the guide belt 144 is rotated, therefore, the tension force component Py for lifting the second roller 142 in a vertical direction is generated as described above and the guide direction G is identical. For this reason, the second roller 142 is lifted.

As a result, the pressing force of the second roller 142 is decreased so that the stable conveyance cannot be carried out.

Next, an eighth exemplary embodiment according to the present disclosure will be described with reference to FIGS. 13 to 16.

Figure 13:
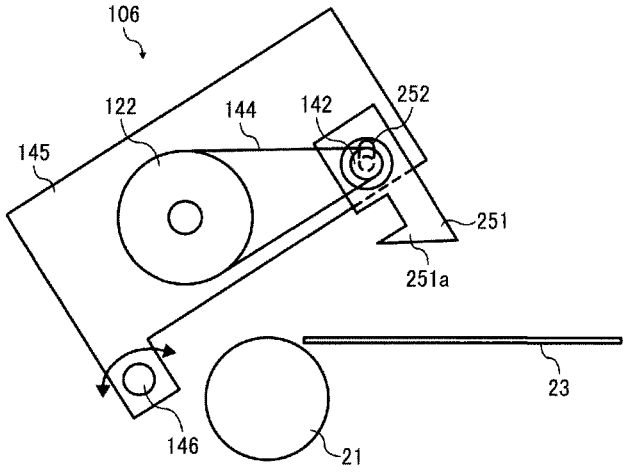
FIG. 13 is a side view of a portion of an image forming apparatus in a returning operation according to an eighth exemplary embodiment of the present disclosure.
Figure 14:
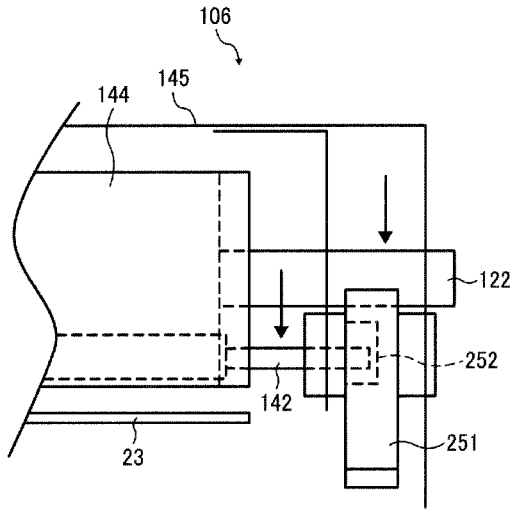
FIG. 14 is a front view of the portion of an image forming apparatus of FIG. 13.
Figure 15:
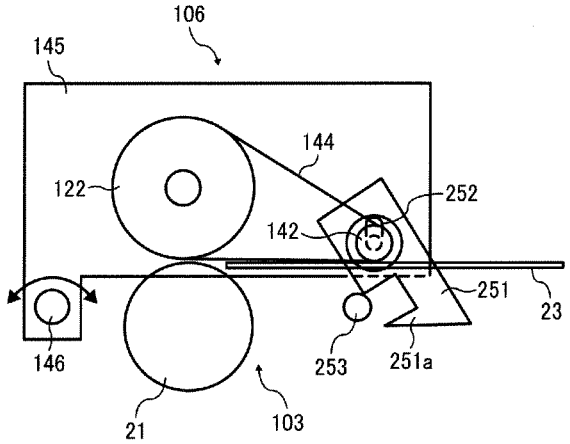
FIG. 15 is a side view of the portion of the image forming apparatus of FIG. 13 in a state in which a locking member is placed at an unlocking position.
Figure 16:
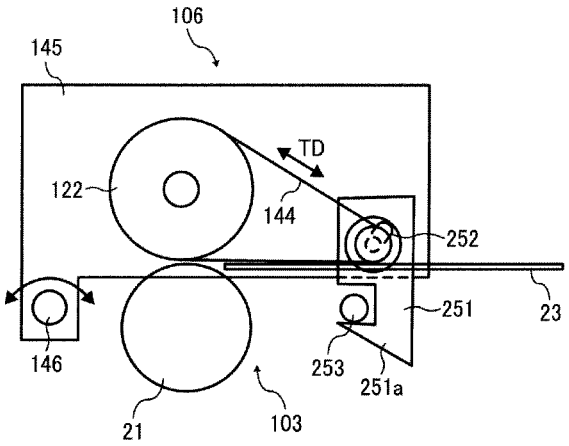
FIG. 16 is a side view of the portion of the image forming apparatus of FIG. 13 in a state in which the locking member is placed at a locking position.

FIG. 13 is a side view of a portion of an image forming apparatus in a returning operation according to an eighth exemplary embodiment of the present disclosure. FIG. 14 is a front view of the portion of an image forming apparatus of FIG. 13. FIG. 15 is a side view of the portion of the image forming apparatus of FIG. 13 in a state in which a locking member is placed at an unlocking position. FIG. 16 is a side view of the portion of the image forming apparatus of FIG. 13 in a state in which the locking member is placed at a locking position.

A holder member 145 for supporting an adhesive face guide unit 106 is disposed rotatably around a shaft 146 and is thus provided separably from a platen member 23 to be a conveyance guide member of a conveyer 103.

The holder member 145 is provided with a locking member 251. The locking member 251 serves as a holding member in order to enable fixation to the conveyer 103.

A locking claw member 251*a* is provided integrally with the locking member 251, and the locking claw member 251*a* is hung on a pin member 253 provided on the conveyer 103 side so that the holder member 145 can be locked.

The locking member 251 is supported rotatably between a first position (an unlocking position) shown in FIG. 15 in which the fixation of the holder member 145 to the conveyer 103 is released and a second position (a locking position) shown in FIG. 16 in which the holder member 145 is fixed to the conveyer 103.

The locking member 251 movably supports the second roller 142 in the same manner as the holding member 151. More specifically, there is provided a guide groove 252 for supporting cylindrical members at both ends of the second roller 142.

When the locking member 251 is placed at the first position in which the fixation of the holder member 145 to the conveyer 103 is released as shown in FIG. 15, the guide groove 252 for supporting the second roller 142 is set into a direction in which the second roller 142 can be moved in a separating direction from the conveyer 103.

When the locking member 251 is placed at the second position in which the holder member 145 is fixed to the conveyer 103 as shown in FIG. 16, moreover, the guide groove 252 for supporting the second roller 142 is set into a direction perpendicular to a tension direction TD of a guide belt 144.

Consequently, a tension force component generated by the rotation of the guide belt 144 and a guide direction in which the second roller 142 can be moved are set to be different directions from each other. Consequently, it is possible to prevent pressing force from being decreased due to the lift of the second roller 142 by the tension component force.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

a roll body including a print medium wound around, the print medium having an adhesive face;

an image forming unit to form an image on the adhesive face of the print medium; and a conveyance unit to convey the print medium to a position at which the print medium opposes the image forming unit, with the adhesive face placed as a front face side of the print medium, wherein the conveyance unit has a pair of a conveyance rotor and an opposed rotor to convey the print medium with the print medium interposed between the conveyance rotor and the opposed rotor and an adhesive face guide unit to guide the print medium when the conveyance unit returns the print medium in a return direction opposite a conveyance direction of the print medium, the adhesive face guide unit has a downstream rotor disposed downstream from the opposed rotor in the return direction and an endless adhesive face guide member wound around the opposed rotor and the downstream rotor, and the endless adhesive face guide member is configured to receive and guide the adhesive face of the print medium returned, in a separable state, and wherein the downstream rotor has a smaller diameter than the opposed rotor.

2. The image forming apparatus of claim 1, wherein a portion of the endless adhesive face guide member from the opposed rotor to the downstream rotor is disposed in a direction along the conveyance direction.

3. The image forming apparatus of claim 1, wherein a portion of the endless adhesive face guide member from the opposed rotor to the downstream rotor is tilted downward or upward relative to a direction along the conveyance direction.

4. The image forming apparatus of claim 1, wherein a portion of the endless adhesive face guide member from the opposed rotor to the downstream rotor is disposed so that an orientation of the portion relative to a direction along the conveyance direction is adjustable.

5. The image forming apparatus of claim 1, wherein the roll body is disposed below the conveyance rotor.

6. The image forming apparatus of claim 1, wherein a portion of the endless adhesive face guide member from the opposed rotor to the downstream rotor is disposed in a direction along the conveyance direction and is longer than a distance at which the print medium is returned in the return direction.

7. The image forming apparatus of claim 1, further comprising a conveyance guide unit to oppose the conveyance unit and guide the adhesive face of the print medium in conveying the print medium in the conveyance direction, wherein the conveyance guide unit comprises a second rotor disposed downstream from the opposed rotor serving as a first rotor, an endless guide belt member wound around the first rotor and the second rotor, and a pressing unit to press the second rotor toward the conveyance unit, and the second rotor is movably disposed with respect to a direction perpendicular to a tension direction of the endless guide belt member.

8. The image forming apparatus of claim 7, further comprising holding members disposed at opposed ends of the second rotor to rotatably and movably hold the second rotor, each of the holding members rotatable between a first position at which the second rotor is movable in a separating direction away from the conveyance unit and a second position at which the second rotor is movable in the direction perpendicular to the tension direction of the endless guide belt member, wherein, when locking of the endless guide belt member with the conveyance unit is released, the each of the holding members is rotated to the first position, and when the endless guide belt member is locked with the conveyance unit, each of the holding members is rotated to the second position.

* * * * *